US006939608B2

(12) United States Patent
Tung

(10) Patent No.: US 6,939,608 B2
(45) Date of Patent: Sep. 6, 2005

(54) BULKED CONTINUOUS FILAMENT HAVING A THREE-SIDED EXTERIOR CROSS-SECTION AND A CONVEX SIX-SIDED CENTRAL VOID AND YARN AND CARPET PRODUCED THEREFROM

(75) Inventor: Wae-Hai Tung, Marietta, GA (US)

(73) Assignee: Invista North America S.a.r.l., Wilmington, DE (US)

( * ) Notice: Subject to any disclaimer, the term of this patent is extended or adjusted under 35 U.S.C. 154(b) by 0 days.

(21) Appl. No.: 10/991,470

(22) Filed: Nov. 19, 2004

(65) Prior Publication Data

US 2005/0112373 A1 May 26, 2005

Related U.S. Application Data

(60) Provisional application No. 60/523,870, filed on Nov. 19, 2003, provisional application No. 60/523,871, filed on Nov. 19, 2003.

(51) Int. Cl.[7] ..... D01F 6/00
(52) U.S. Cl. ..... 428/397; 428/398; 428/92
(58) Field of Search ..... 428/397, 398, 428/92

(56) References Cited

U.S. PATENT DOCUMENTS 3,329,553 A 7/1967 Sims et al.
5,108,838 A 4/1992 Tung
5,176,926 A 1/1993 Tung
5,380,592 A 1/1995 Tung
5,523,155 A * 6/1996 Lin et al. ..... 428/376
6,048,615 A 4/2000 Lin
6,589,653 B2 * 7/2003 Lin ..... 428/398
6,600,375 B1 * 7/2003 Morse et al. ..... 330/296
6,675,450 B1 * 1/2004 Fetter et al. ..... 29/25.35
6,677,903 B2 * 1/2004 Wang ..... 343/702
6,855,425 B2 * 2/2005 Lancaster ..... 428/397

* cited by examiner

*Primary Examiner*—N. Edwards

(57) ABSTRACT

A bulked continuous filament with a three-sided exterior configuration is characterized in that each side has a smoothly curved contour extending between a first and a second rounded tip with an inwardly extending depressed region being disposed adjacent to each tip. Generally, the filament has an exterior modification ratio in the range from about 1.4 to about 2.0, and a tip ratio in the range from about 2.0 to about 4.0. The filament generally delta-shaped void with three major apices extending centrally and axially therethrough. Each side of the void is convexly shaped and formed from a pair of facets that meet to define minor apices. The void is oriented such that each major apex extends toward the approximate midpoint of one side of the exterior of the filament and each minor apex extends toward a tip of an exterior side. The distance ($R_M$) from the geometric center of the void to each major apex and the distance ($R_m$) from the geometric center of the void to each minor apex defines an apex ratio ($R_M/R_m$) in the range from about 1.0 to about 1.55. The void occupies from about four percent (4%) to about twenty-five percent (25%) of the cross sectional area of the filament.

15 Claims, 3 Drawing Sheets

BULKED CONTINUOUS FILAMENT HAVING A THREE-SIDED EXTERIOR CROSS-SECTION AND A CONVEX SIX-SIDED CENTRAL VOID AND YARN AND CARPET PRODUCED THEREFROM

CROSS-REFERENCE TO RELATED APPLICATION

This application is a U.S. Utility patent application claiming priority to provisional application No. 60/523,870, filed Nov. 19, 2003 and provisional application No. 60/523,871, filed Nov. 19, 2003.

FIELD OF THE INVENTION

The present invention relates to a bulked continuous filament having an exterior configuration of three smoothly contoured sides with an inwardly extending depressed region located adjacent each tip of each side and with a convex, generally delta-shaped, six-sided central void extending therethrough.

DESCRIPTION OF THE PRIOR ART

While carpet yams having relatively high levels of "glitter" have become fashionable there nevertheless remains a substantial demand for yarns which provide a lower glitter, more wool-like appearance with superior soil hiding, and which cover more surface area with lower face weights.

"Glitter" is the property of the yam relating to the yarn's ability to reflect incident light. The amount of glitter exhibited by a yam is a measure of the relative fraction of light that is reflected by the yam. "Bulk" is the property of the yarn, which most closely correlates to surface coverage ability of a given yarn.

U.S. Pat. No. 3,329,553 (Sims et al.) discloses a trilobal filament having a void fraction in the range from ten to sixty-five percent (10–65%). This reference teaches that void ratio is correlated with bulk in that the higher the void ratio the greater the bulk.

U.S. Pat. No. 6,048,615 (Lin, RD-7395), assigned to the assignee of the present invention, discloses a trilobal filament with concave-sided voids formed from a thermoplastic synthetic polymer. This yarn exhibits excellent durability and good soiling resistance, but has relatively high glitter.

U.S. Pat. Nos. 5,108,838 and 5,176,926 (both to Tung), both assigned to the assignee of the present invention, discloses a solid trilobal filament formed from a thermoplastic synthetic polymer material which exhibits low glitter. The structure of this yarn provides less bulk and is somewhat less effective in hiding soil than the current invention.

U.S. Pat. No. 5,380,592 (Tung), assigned to the assignee of the present invention, discloses a trilobal cross-section with three voids which improve bulk and soil hiding compared to the solid cross-section trilobal filament discussed immediately above. However, this yarn is still somewhat vulnerable to soiling owing to the channels or "cusps" in the sides. Filaments of this yarn are also more subject to discontinuity in the spinning process owing to the complexity of the spinneret used to form the yarn. Open voids may occur in individual filaments, resulting in severe dyeability differences from filament to filament.

In view of the foregoing it is believed advantageous to provide a synthetic filament and a yarn made therefrom that is easily bulked, that exhibits a relatively low glitter and that is contoured to resist soil accumulation.

SUMMARY OF THE INVENTION

The present invention is directed to a thermoplastic synthetic polymer bulked continuous filament and to a yam formed from a plurality of such filaments which is easily bulked and, due to its low glitter and lack of soil accumulating surfaces, is believed to be especially useful as carpet yam. The invention is also directed to a carpet made from such yams.

The filament of the present invention has a three-sided exterior configuration and a minor radius ($R_1$) and a major radius ($R_2$). The ratio of the major radius ($R_2$) to the minor radius ($R_1$) defines an exterior modification ratio ($R_2/R_1$) in the range from about 1.4 to about 2.0, and more particularly in the range from 1.6 to 1.8.

Each side of the filament is defined by a smoothly curved contour that extends between a first and a second rounded tip. An inwardly extending depressed region is disposed adjacent to each tip of each side. Each rounded tip has a tip radius ($R_3$), the ratio of the tip radius ($R_3$) to the major radius ($R_2$) defining a tip ratio ($R_2/R_3$) in the range from about 2.0 to about 4.0, and more particularly in the range from 2.0 to 3.0.

The filament has a generally "delta-shaped" void extending centrally and axially therethrough. The void has a geometric center and three major apices. Each side of the void is convexly shaped and is formed from two facets that meet to define a minor apex intermediate the first and second ends thereof. The distance ($R_M$) from the geometric center of the void to each major apex and the distance ($R_m$) from the geometric center of the void to each minor apex defines an apex ratio ($R_M/R_m$) in the range from about 1.0 to about 1.55, and more particularly in the range from 1.05 to 1.50.

The void is oriented within the filament such that each major apex of the void extends toward the approximate midpoint of one respective side of the exterior configuration of the filament and each minor apex extends toward an exterior tip. The void occupies from about four percent (4%) to about twenty-five percent (25%), and more particularly about four percent (4%) to about fifteen percent (15%) of the cross sectional area of the filament.

BRIEF DESCRIPTION OF THE DRAWINGS

The invention will be more fully understood from the following detailed description, taken in connection with the accompanying drawings, which form a part of this application and in which.

DETAILED DESCRIPTION OF THE INVENTION

Figure 1:
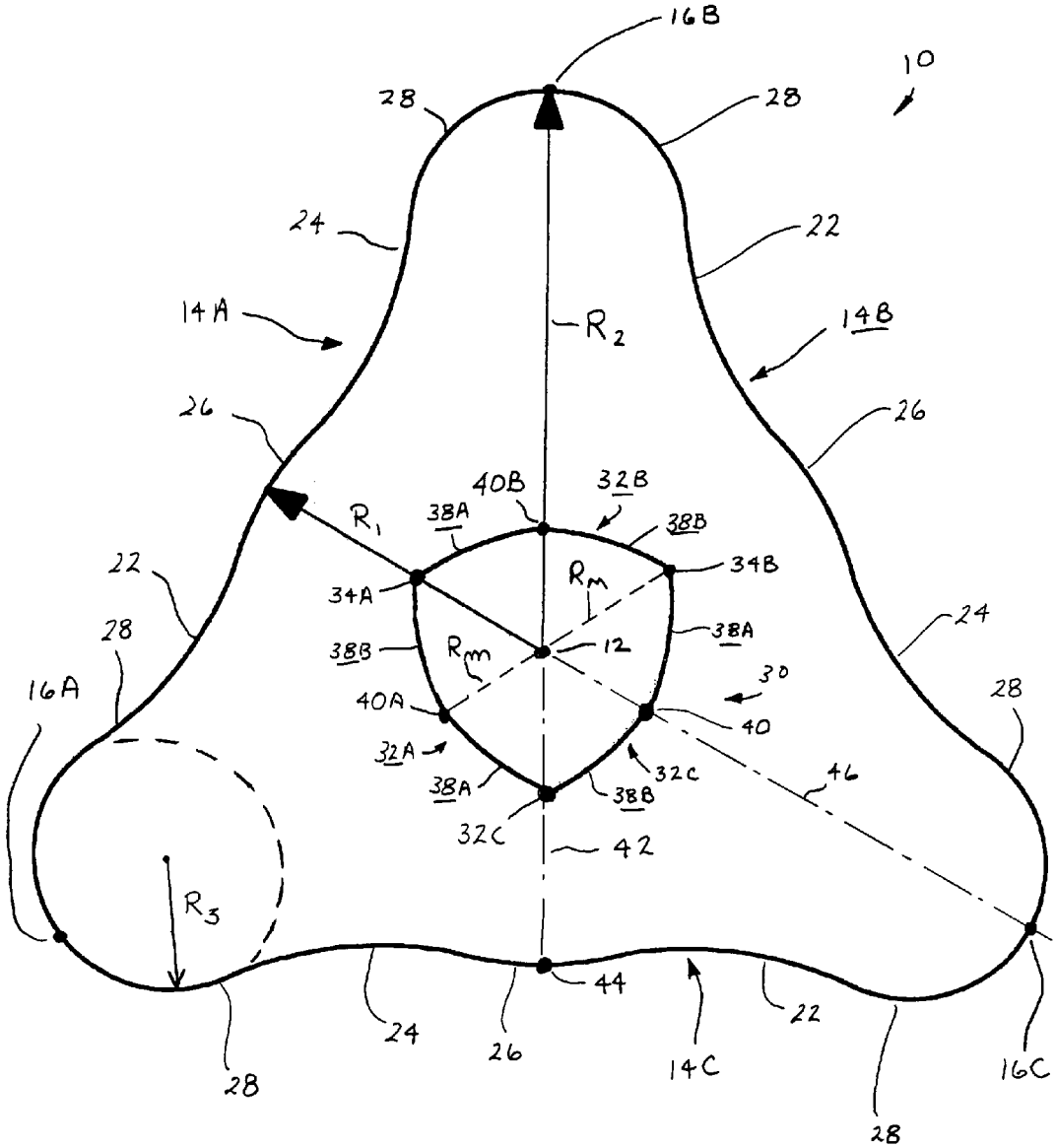
FIG. 1 is a cross sectional view of a bulked continuous filament in accordance with the present invention.

Throughout the following detailed description similar reference numerals refer to similar elements in all Figures of the drawings.

FIG. 1 is a cross section view of a bulked continuous filament generally indicated by reference character 10 in accordance with the present invention. A longitudinal axis 12 extending through the filament 10 serves its geometric center. The distance from the axis 12 to the point(s) on the exterior contour of the filament 10 closest to the axis defines the minor radius ($R_1$) of the filament. A major radius ($R_2$) is defines the distance from the axis 12 to the point(s) on the exterior contour of the filament that lie farthest therefrom.

Each filament 10 has a generally three-sided exterior configuration formed from sides 14A, 14B and 14C. The side 14A is defined by a smoothly curved contour extending between a first rounded tip 16A and a second rounded tip 16B. The side 14B is defined by a smoothly curved contour extending between the second rounded tip 16B and a third rounded tip 16C. The side 14C is defined by a smoothly curved contour extending between the third rounded tip 16B and the rounded first tip 16A. The distance from a respective center of generation 18A, 18B, 18C to each rounded tip 16A, 16B, 16C is indicated by a tip radius $R_3$ (only one of which is illustrated in FIG. 1 for clarity of illustration).

Each exterior side 14A, 14B, 14C has a first inwardly extending depressed region 22 disposed near one tip and a second inwardly extending depressed region 24 disposed near the other tip. By "depressed region" it is meant that the contour of the filament in that region extends inwardly toward the axis 12 of the filament. The intermediate region 26 of each side 14A, 14B, 14C (i.e., the region between the depressed regions 22, 24 on that side) is bowed slightly outwardly from the axis 12. Each exterior side 14A, 14B, 14C of the filament 10 thus exhibits a generally "wavy" configuration having two concave regions (i.e., the depressed regions 22, 24) and three convex regions (i.e., the bowed intermediate region 26 and the rounded regions 28 disposed near each rounded tip of each side).

In general a filament 10 in accordance with the present invention has an exterior modification ratio ($R_2/R_1$) in the range from about 1.4 to about 2.0, and more particularly in the range from about 1.6 to about 1.8. In addition, the ratio of the major radius ($R_2$) to the tip radius ($R_3$) defines a tip ratio ($R_2/R_3$) in the range from about 2.0 to about 4.0, and more particularly in the range from about 2.0 to about 3.0.

The filament 10 has a void 30 extending centrally and axially therethrough. The axis 12 defines the geometric center of the void. The central void 30 is a generally "delta-shaped" opening having three generally convex major sides 32A, 32B, 32C. Adjacent pairs of major sides 32A, 32B, 32C join at adjacent ends to define three major apices 34A, 34B, 34C. In accordance with the present invention each side 32A, 32B, 32C is itself configured from a pair of discernable facets 38A, 38B. The facets 38A, 38B may be planar in contour or may be gently curving to approximate a planar contour. The facets 38A, 38B meet to define a minor apex 40A, 40B, 40C located intermediate the ends of each respective major side 32A, 32B, 32C. The major apices 34A, 34B, 34C lie a distance $R_M$ from the geometric center 12 of the void 30 while the minor apices 40A, 40B, 40C are spaced a distance $R_m$ from the same point. The ratio of the distance ($R_M$) to the distance ($R_m$) defines an apex ratio ($R_M/R_m$) in the range from about 1.0 to about 1.55, and more particularly in the range 1.05 to 1.50.

The void 30 may occupy from about four percent (4%) to about twenty-five percent (25%), and more particularly from about four percent (4%) to about fifteen percent (15%), of the cross sectional area of the filament 10.

In accordance with the present invention the central void 30 is oriented within the filament 10 such that each major apex 34A, 34B, 34C of the void 30 extends toward the approximate midpoint of the respective proximal side 14A, 14B, 14C of the filament 10, while each minor apex 40A, 40B, 40C extends toward the respective proximal rounded tip 16A, 16B, 16C.

These relationships are exemplified in FIG. 1 by the radial reference line 42 extending from the axis 12 of the filament 10 through the major apex 34C and a point 44 disposed substantially midway along the intermediate region 26 of the side 14C. Similar reference lines, omitted for clarity, may be drawn through the other major apices 34A, 34B and a substantial midpoint of the intermediate region on the respective proximal sides 14A, 14B of the exterior of the filament 10. The alignment of the minor apices and the rounded tip of the filament is exemplified in FIG. 1 by a radial reference line 46 extending from the axis 12 of the filament 10 through the minor apex 40C and the rounded tip 16C of the filament. Similar reference lines, again omitted for clarity, may be drawn through the minor apices 40A, 40B and the respective rounded tips 16A, 16B of the filament.

A filament in accordance with the present invention is a bulked continuous filament prepared using a synthetic, thermoplastic melt-spinnable polymer. Suitable polymers include polyamides, polyesters, and polyolefins. The polymer is first melted and then is extruded ("spun") through a spinneret plate 50 having appropriately sized orifices therein (to be described hereinafter) under conditions which vary depending upon the individual polymer thereby to produce a filament 10 having the desired denier, exterior modification ratio, tip ratio, apex ratio and void percentage. The filaments are subsequently quenched by air flowing across them at a flow rate of between 1.2–1.8 ft/sec (0.36 to 0.55 m/sec). Void percentage can be increased by more rapid quenching and increasing the melt viscosity of thermoplastic melt polymers, which can slow the flow allowing sturdy pronounced molding to occur.

A plurality of filaments 10 are gathered together to form a yarn. Drawing and bulking of the combined filaments is performed by any method known in the art, with the preferred operating condition described below in the examples provided.

Owing to the particular desired properties of the filaments 10 a yarn formed therefrom is believed to be particularly advantageous for tufting [with other types of yam(s), if desired] into carpet having especially desirable properties. If desired, the yarn could include other forms of filament(s).

Figure 2:
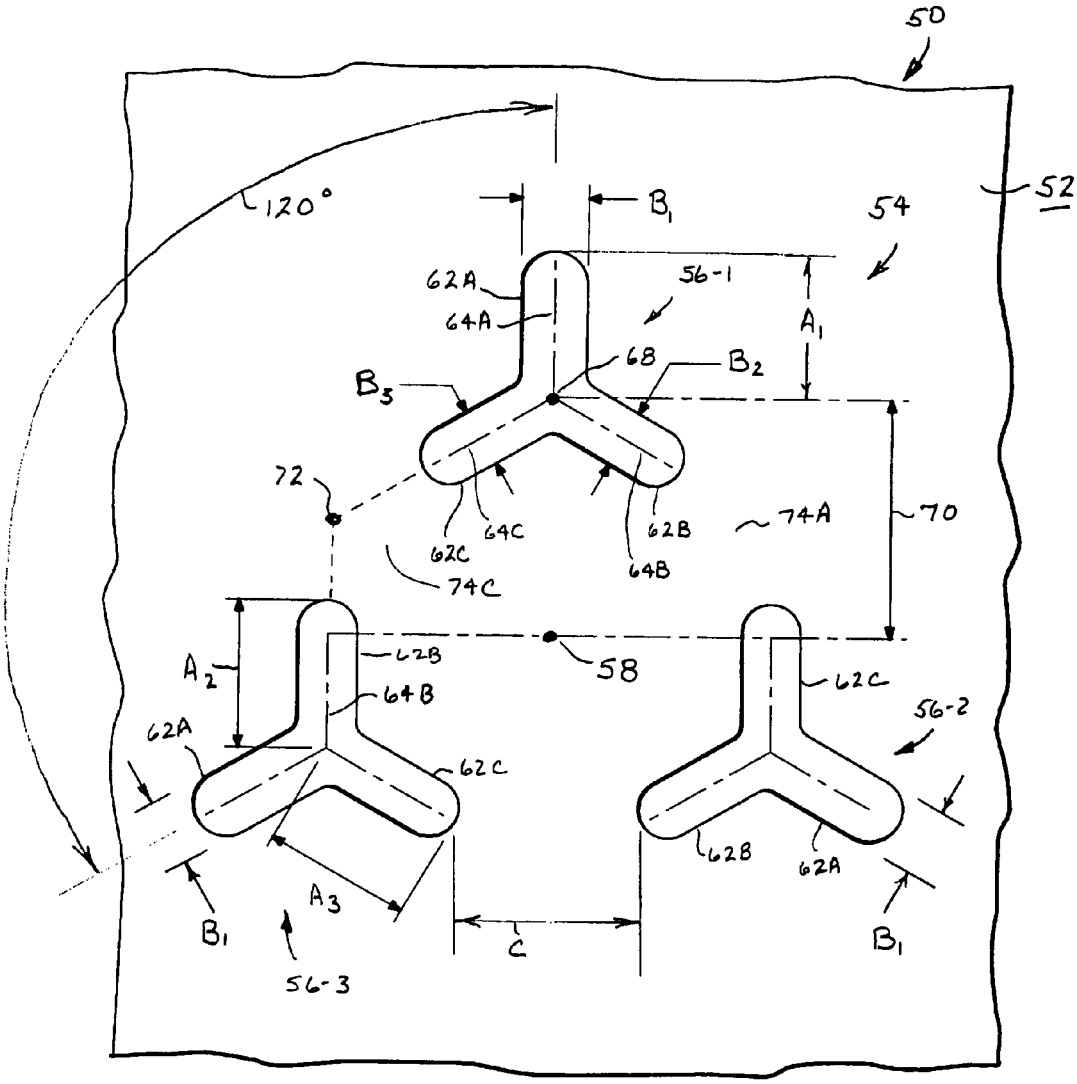
FIG. 2 is a view of the bottom surface of a spinneret plate having a cluster of orifices formed therein for producing the filament shown in FIG. 1.

FIG. 2 illustrates a spinneret plate 50 useful for producing a filament 10 in accordance with the invention.

The spinneret plate 50 is a relatively massive member having an upper surface (not shown) and a bottom surface 52. As is well appreciated by those skilled in the art a portion of the upper surface of the spinneret plate is provided with a bore recess (not shown) whereby the plate 50 is connected to a source of polymer. Depending upon the rheology of the polymer being extruded the lower margins of the bore recess may be inclined to facilitate flow of polymer from the supply to the spinneret plate.

A plurality of capillary openings each generally indicated by the reference character 54 extends through the plate 50 from the recessed upper surface to the bottom surface 52. Each capillary opening 54 serves to form one filament. Only one such capillary opening 54 is illustrated in FIG. 2. The number of capillary openings provided in a given plate thus corresponds to the number of filaments being gathered to form a predetermined number of yarn(s). As noted, additional filaments (if used) may be incorporated into the yarn in any convenient manner.

As best seen in FIG. 2, in the present invention each capillary opening 54 is itself defined by a cluster of three orifices 56-1, 56-2 and 56-3 centered symmetrically about a central point 58.

Each orifice 56-1, 56-2 and 56-3 is a generally "Y"-shaped opening comprising three linear legs 62A, 62B and 62C. Each leg 62A, 62B and 62C has a respective longitudinal axis 64A, 64B, 64C extending therethrough. The axes 64A, 64B, 64C are angularly spaced from each other by one hundred twenty degrees (120°). The axes 64A, 64B, 64C of the legs 62A, 62B and 62C of each orifice intersect at a junction point 68. The junction points 68 are spaced a distance 70 from the center point 58 of the cluster.

The orifices 56-1, 56-2 and 56-3 are arranged with respect to each other such that one leg of each orifice 56-1, 56-2 and 56-3, e.g., the leg 62A, extends from the junction point 68 in a radially outward direction relative to the central point 58. Stated alternatively, the radially outwardly extending leg 62A of each orifice 56-1, 56-2 and 56-3 is oriented such that its axis 64A aligns with a radius 70 extending outwardly from the central point 58. Each junction point 68 of the orifices 56-1, 56-2, 56-3 respectively corresponds to a major apex 34A, 34B, 34C of the void 30 of the filament being spun.

The other two legs 62B, 62C of each orifice 56-1, 56-2 and 56-3 are arranged such that the axes 64B, 64C thereof project toward an apex point 72 disposed intermediate adjacent orifices. Extensions of each of the axes 64B, 64C of these legs 62B, 62C intersect at an apex point 72. Each apex point 72 corresponds to a respective minor apex 40A, 40B, 40C of the void 30 of the filament being spun. The ends of the confronting legs 62B, 62C are spaced from each other by a gap 74A, 74B, 74C. The dimension of the gaps 74A, 74B, 74C is indicated by the reference character C. The legs 62A, 62B, 62C of each of Y-shaped orifice 56-1, 56-2 and 56-3, when measured along their respective axes, are equal in length. The length dimensions of the legs 62A, 62B, 62C are indicated by the respective reference character $A_1$, $A_2$, $A_3$.

The width dimensions of the legs 62A, 62B, 62C are indicated by the respective reference character B1, B2, B3. The width dimension of the radially extending leg 62A (indicated by the reference character $B_1$) is wider than the width dimensions (indicated by the reference characters $B_2$, $B_3$) of the other legs 62B, 62C.

The spinneret plate may be fabricated in any appropriate manner, as by using the laser technique disclosed in U.S. Pat. No. 5,168,143, (Kobsa et al., QP-4171-A), assigned to the assignee of the present invention.

The following Table presents the magnitudes of the various dimensions $A_1$, $A_2$, $A_3$, $B_1$, $B_2$, $B_3$, and C used to fabricate filaments having the cross section illustrated in FIG. 1 used in invention Example 1 and Invention Example 2. The dimensions are in inches, with the corresponding metric measurement given parenthetically in centimeters.

TABLE 1

| | $A_1$, $A_2$, $A_3$ | $B_1$ | $B_2$, $B_3$ | C |
|---|---|---|---|---|
| FIG. 1A | 0.0153 | 0.0073 | 0.0061 | 0.0186 |
| (Invention Example 1) | (0.0389) | (0.019) | (0.015) | (0.047) |
| FIG. 1B | 0.0214 | 0.0052 | 0.0044 | 0.0247 |
| (Invention Example 2) | (0.054) | (0.013) | (0.011) | (0.062) |

Trilobal cross sections with voids (hollow filament) have been practiced in the past [e.g., U.S. Pat. No. 6,048,615 (Lin)]. However, hollow filament yams are difficult to make because of cross section shape control. Void percent and exterior modification ratio are both sensitive to polymer viscosity and quench air flow. As is well understood by one skilled in the art, without tight control of these parameters, lack of cross section shape uniformity can result in streaks when the yams are finally tufted into a carpet.

The combination of the three orifices taken together with the enlarged width dimension ($B_1$) of the radially outwardly extending leg of each orifice causes polymer streams emanating from each orifice to converge, thus producing surprisingly stable polymer flow that is less prone to filament breakage and process interruption than the more complicated spinnerets of the prior art.

The stable polymer flow provided by the use of the spinneret in accordance also results in surprising robustness of cross section formation in the spinning process. The fiber cross section shape is measurably less sensitive to quench airflow, and thus provides a distinct advantage versus the prior art as a result of the greater consistency of shape provided along the length of the formed filaments and yarns made therefrom.

In addition, the disclosed spinneret plate is especially useful in the manner of producing the disclosed filament cross-section because it is simpler and less expensive to produce than previous hollow filament spinnerets.

EXAMPLES

Spinning Process:

Nylon 6,6 filaments having various cross-sections were produced for Comparative Examples A and B and for Invention Examples 1 and 2 from appropriately configured spinnerets, each with one hundred thirty-six (136) capillaries.

The nylon 6,6 polymer used for all of the examples was a bright polymer. The polymer spin dope did not contain any delusterant and had a relative viscosity (RV) of sixty-eight plus/minus approximately three units (68, +/_~3 units). The polymer temperature before the spinning pack was controlled at about two hundred ninety plus/minus one degree Centigrade (290, +/_1° C.). The spinning throughput was seventy pounds (70 lbs; 31.8 kg) per hour.

The relative viscosity (RV) was measured by dissolving 5.5 grams of nylon 6,6 polymer in fifty cubic centimeters (50 cc) of formic acid. The RV is the ratio of the absolute viscosity of the nylon 66/formic acid solution to the absolute viscosity of the formic acid. Both absolute viscosities were measured at twenty-five degrees Centigrade (25° C.).

The polymer was extruded through the different spinnerets and divided into two (2) sixty-eight filament (68) segments. The capillary dimensions for the spinnerets are described below. The molten fibers were then rapidly quenched in a chimney, where cooling air at about nine degrees Centigrade (~9° C.) was blown past the filaments at three hundred cubic feet per minute [300 cfm (732 m/min)] through the quench zone. The filaments were then coated with a lubricant for drawing and crimping. The coated yams were drawn at 2197 yards per minute (2.75×draw ratio) using a pair of heated draw rolls. The draw roll temperature was one hundred ninety degrees Centigrade (190° C.). The filaments were then forwarded into a dual-impingement hot air bulking jet similar to that described in Coon, U.S. Pat. No. 3,525,134 (Coon, assigned to the assignee of the present invention) to form two (2) twelve hundred five denier (1205 denier, 1340 decitex), 17.7 denier per filament (dpf) yams (19 decitex per filament). The temperature of the air in the bulking jet was two hundred twenty degrees Centigrade (220° C.).

The spun, drawn, and crimped bulked continuous filament (BCF) yams were cable-twisted to 3.2 turns per inch (tpi) on a cable twister and heat-set on a Superba heat-setting machine at setting temperature of two hundredt sixty degrees Farenheit (265° F.; 129.4° C.).

The yams were then tufted into twenty-eight ounce per square yard (28 oz/sq. yd; 949 g/sq. meter) having 0.21875 inch [7/32", 0.56 cm] pile height loop pile carpets on a 1/10 inch gauge (0.254 cm) loop pile tufting machine. The tufted carpets were dyed on a continuous range dyer into medium yellow carpets.

Test Methods:

Each carpet sample produced from the yams of Comparative Examples A and B and Invention Examples 1 and 2 was subjected to the following tests.

Carpet Glitter and Bulk Ratings. The degrees of bulk and glitter for different cut-pile carpet samples were visually compared in a side-by side comparison without knowledge of which carpets were made with which yams. The carpets were examined by a panel of five (5) experienced examiners each familiar with carpet construction and surface texture. The glitter value was measured by the examiners on a scale of "1" to "5", with "5" being the most glitter. The glitter rating for each sample was averaged and the samples given a rating of low, medium or high glitter based on the average rating. Carpet bulk was rated in the same manner. The glitter and bulk results are reported in Table 2.

Soiling Test:

The soiling test was conducted on each carpet sample using a Vetterman drum.

The base color of the sample was measured using the hand held color measurement instrument sold by Minolta Corporation as "Chromameter" model CR-210. This measurement was the control value.

The carpet sample was placed in Vetterman drum. Two hundred grams (200 g) of clean nylon 101 Zytel nylon beads and fifty grams (50 g) of dirty beads (by DuPont Canada, Mississauga, Ontario) were placed on the sample. The dirty beads were prepared by mixing ten grams (10 g) of AATCC TM-122 synthetic carpet soil (by Manufacturer Textile Innovators Corp. Windsor, N.C.) with one thousand grams (1000 g) of new Nylon 101 Zytel beads. Sixteen to seventeen hundred grams (1600–1700 g) of ceramic cylindrical shaped beads [110 to 130½" diameter×½" length small beads and twenty-five to thirty-five (25 to 35) ¾" diameter, ¾" length (1.91 cm diameter, 1.91 cm length) large beads were added into the Vetterman drum. The Vetterman drum was run for five hundred (500) cycles and the sample removed.

The color of the sample was again measured and the color change versus the control value (delta E) owing to soiling was recorded as an "As Soiled" value [note: This interim result is not reported in Table 2]. The sample was vacuumed four (4) times in both the length and width directions and the color was again measured and the color change versus control value (delta E) after vacuuming was recorded as an "As Cleaned" value [note: This interim result is not reported in Table 2].

The sample was placed back in the drum, fifty grams (50 g) of soiled bead mixture was discarded and fifty grams (50 g) of new dirty beads were added into the drum.

The procedure described above was repeated for three additional five hundred (500) cycle runs.

After a total of two thousand (2000) cycles, the color of the sample versus the control value (delta E) "As Soiled" was measured and reported. The color change versus the control value after vacuuming (the "As Cleaned" value) was measured and recorded. These measurements (i.e., the "As Soiled" and the "As Cleaned" values taken after two thousand cycles) are reported in Table 2 in the columns "As Soiled" and "As Cleaned", respectively. Samples with a high value of delta E perform worse than samples with low delta E value.

Comparative Example A

Figure 3:
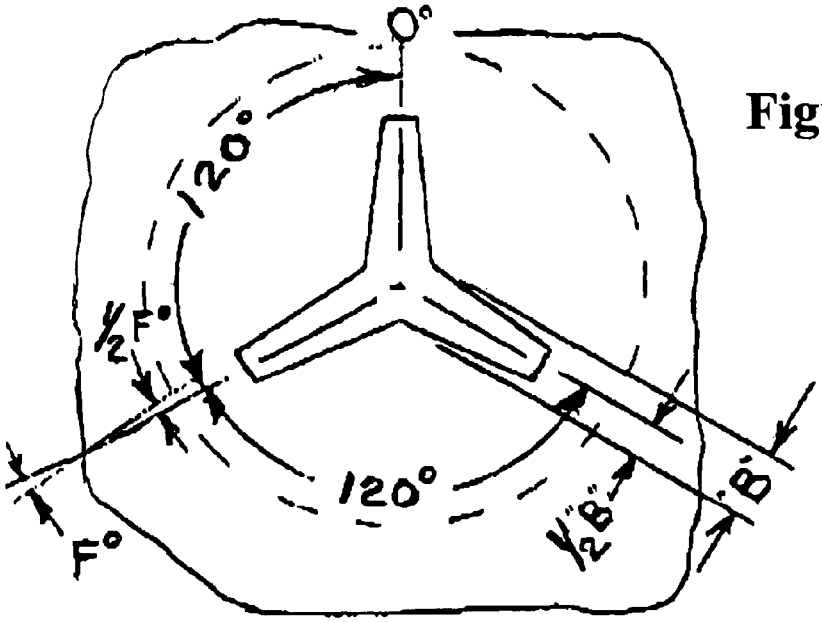
FIG. 3 is a view of the bottom surface of a spinneret plate used for spinning the filaments of Comparative Example 1.

Filaments having a trilobal cross-section as disclosed in U.S. Pat. No. 4,492,731 (Bankar et al.), assigned to the assignee of the present invention, were made using the above-described spinning process. The filaments were spun through a spinneret capillary as shown in FIG. 3 having three tapered arms (lobes) which were essentially symmetrical.

Comparative Example B

Figure 4:
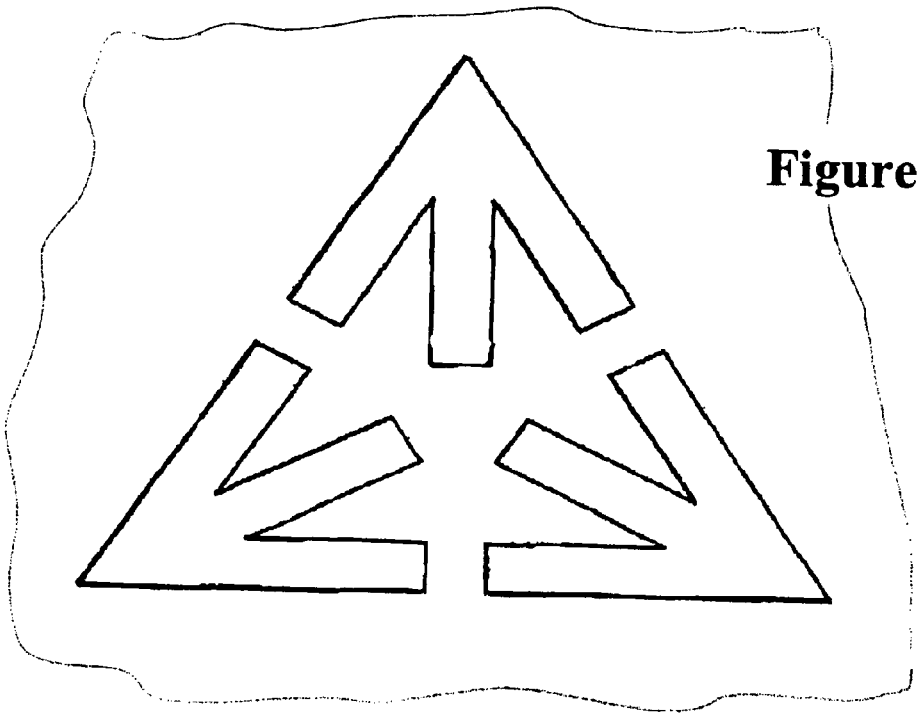
FIG. 4 is a view of the bottom surface of a spinneret plate used for spinning the filaments of Comparative Example 2.

Filaments having a hollow trilobal cross section as disclosed in U.S. Pat. No. 6,048,615 (Lin), assigned to the assignee of the present invention, were made using the above-described spinning process. The filaments were spun through a spinneret capillary as shown in FIG. 4.

Invention Example 1

Filaments having a hollow trilobal cross section as described by this invention, as shown in FIG. 1B, were made using the above-described process. The filaments were spun through a spinneret capillary as shown in FIG. 2. The dimensions $A_1$, $A_2$, $A_3$, $B_1$, $B_2$, $B_3$, C used to produce Invention Example 1 are as set forth in Table 1.

The filament had an exterior modification ratio of 1.66, a tip ratio of 2.6, an apex ratio of 1.08. The central void occupied about 5.3 percent of the cross sectional area of the filament.

Invention Example 2

Filaments having a hollow trilobal cross section as described by this invention, as shown in FIG. 1C were made using the above-described process. The filaments were spun through a spinneret capillary as shown in FIG. 2. The dimensions $A_1$, $A_2$, $A_3$, $B_1$, $B_2$, $B_3$, C used to produce Invention Example 2 are as set forth in Table 1.

The filament had an exterior modification ratio of 1.88, a tip ratio of 3.5, an apex ratio of 1.33. The central void occupied about ten percent (10%) of the cross sectional area of the filament.

The test results are summarized below in Table 2.

TABLE 2

| Example | Cross-section (exterior MR) | Soiling (ΔE) As Soiled | Soiling (ΔE) Cleaned | Glitter | Bulk |
|---|---|---|---|---|---|
| Comp. A | Solid trilobal (2.6 MR) | 23.25 | 21.14 | High | High |
| Comp. B | Hollow trilobal (—.— MR) | N/A | N/A | High | Medium |
| Inv. 1 | 1.66 | 17.94 | 16.71 | Low | Medium |
| Inv. 2 | 1.88 | 21.17 | 19.86 | Low | High |

As can be appreciated from Table 2, Examples 1 and 2 (having relatively "wavy" sides including two concave and three convex surfaces and a void shaped and oriented in the manner shown in FIG. 1) demonstrate distinctly different and lower "Glitter" in the final carpet than do Comparative Examples A and B. The filament and yarn of the present invention is useful as a carpet yarn having more "wool-like" appearance when made into carpet than yarns of the prior art having similar bulk, soiling and cleaning characteristics.

The filament of the invention is also smoother (i.e., with rounded tips and without sharply defined cusps) and therefore less prone to soiling than other known high bulk trilobal fibers that can otherwise impart similar aesthetics to a carpet made therefrom, as is clearly supported by the soiling data in Table 2. A carpet constructed from yarn of the present invention therefore retains its appearance longer in service than carpets made from yarn of the prior art.

To achieve high bulk with low glitter is generally believed to be difficult. The invention provides a surprisingly low glitter yarn that can produce carpets of comparable bulk to carpets made from such high glitter yarns as the solid trilobal cross section filaments (Comparative Example A).

As a result of the configuration filaments in accordance with this invention and yarns formed therefrom are easily bulked and exhibit a relatively low glitter while the exterior contour resists soil accumulation.

What is claimed is:

1. A bulked continuous filament formed from a synthetic polymer, the filament having a three-sided exterior configuration and a minor radius ($R_1$) and a major radius ($R_2$), the ratio of the major radius ($R_2$) to the minor radius ($R_1$) defining an exterior modification ratio ($R_2/R_1$) in the range from about 1.4 to about 2.0, each side defining a smoothly curved contour extending between a first and a second rounded tip, each side having an inwardly extending depressed region disposed adjacent to each rounded tip, each rounded tip having a tip radius ($R_3$), the ratio of the major radius ($R_2$) to the tip radius ($R_3$) defining a tip ratio ($R_2/R_3$) in the range from about 2.0 to about 4.0, the filament having a generally delta-shaped void extending centrally and axially therethrough, the void having a geometric center and three major apices, each side of the void being convex in shape and having a first and a second end, each side of the void being formed from two facets that meet to define a minor apex intermediate the first and second ends thereof, the distance ($R_M$) from the geometric center of the void to each major apex and the distance ($R_m$) from the geometric center of the void to each minor apex defining an apex ratio ($R_M/R_m$) in the range from about 1.0 to about 1.55, the void being oriented within the filament such that each major apex extends toward the approximate midpoint of one side of the exterior of the filament and each minor apex extends toward an exterior tip of a filament, the void occupying from about four percent (4%) to about twenty-five percent (25%) of the cross sectional area of the filament.

2. The bulked continuous filament of claim 1 wherein the exterior modification ratio ($R_2/R_1$) is in the range from about 1.6 to about 1.8.

3. The bulked continuous filament of claim 1 wherein the tip ratio ($R_2/R_3$) is in the range from about 2.0 to about 3.0.

4. The bulked continuous filament of claim 1 wherein the apex ratio ($R_M/R_m$) is in the range from about 1.05 to about 1.50.

5. The bulked continuous filament of claim 1 wherein the void occupies from about four percent (4%) to about fifteen percent (15%) of the cross sectional area of the filament.

6. A bulked continuous yarn formed comprising a plurality of bulked continuous filaments, each bulked continuous filament in the yarn being formed from a synthetic polymer and having a three-sided exterior configuration and a minor radius ($R_1$) and a major radius ($R_2$), and wherein, for each said filament the ratio of the major radius ($R_2$) to the minor radius ($R_1$) defining an exterior modification ratio ($R_2/R_1$) in the range from about 1.4 to about 2.0, each side defining a smoothly curved contour extending between a first and a second rounded tip, each side having an inwardly extending depressed region disposed adjacent to each rounded tip, each rounded tip having a tip radius ($R_3$), the ratio of the major radius ($R_2$) to the tip radius ($R_3$) defining a tip ratio ($R_2/R_3$) in the range from about 2.0 to about 4.0, each filament having a generally delta-shaped void extending centrally and axially therethrough, the void having a geometric center and three major apices, each side of each void being convex in shape and having a first and a second end, each side of each void being formed from two facets that meet to define a minor apex intermediate the first and second ends thereof, the distance ($R_M$) from the geometric center of the void to each major apex and the distance ($R_m$) from the geometric center of the void to each minor apex defining an apex ratio ($R_M/R_m$) in the range from about 1.0 to about 1.55, each void being oriented within a filament such that each major apex of the void extends toward the approximate midpoint of one side of the exterior of the filament and each minor apex extends toward an exterior tip of a filament, each void occupying from about four percent (4%) to about twenty-five percent (25%) of the cross sectional area of the filament.

7. The bulked continuous yarn of claim 6 wherein the exterior modification ratio ($R_2/R_1$) of each of said bulked continuous filament is in the range from about 1.6 to about 1.8.

8. The bulked continuous yarn of claim 6 wherein the tip ratio ($R_2/R_3$) of each of said substantially all of the bulked continuous filaments is in the range from about 2.0 to about 3.0.

9. The bulked continuous yarn of claim 6 wherein the wherein the apex ratio ($R_M/R_m$) of each of said bulked continuous filament is in the range from about 1.05 to about 1.50.

10. The bulked continuous yarn of claim 6 wherein the void of each of said bulked continuous filament occupies from about four percent (4%) to about fifteen percent (15%) of the cross sectional area of the filament.

11. A carpet comprising a plurality of bulked continuous yarns tufted into a backing, each yarn comprising a plurality of bulked continuous filaments, each said bulked continuous filament in each said yarn being formed from a synthetic polymer and having a three-sided exterior configuration and a minor radius ($R_1$) and a major radius ($R_2$), and wherein, for each said filament the ratio of the major radius ($R_2$) to the minor radius ($R_1$) defining an exterior modification ratio ($R_2/R_1$) in the range from about 1.4 to about 2.0, each side defining a smoothly curved contour extending between a first and a second rounded tip, each side having an inwardly extending depressed region disposed adjacent to each rounded tip, each rounded tip having a tip radius ($R_3$), the ratio of the major radius ($R_2$) to the tip radius ($R_3$) defining a tip ratio ($R_2/R_3$) in the range from about 2.0 to about 4.0, each filament having a generally delta-shaped void extending centrally and axially therethrough, the void having a geometric center and three major apices, each side of each void being convex in shape and having a first and a second end, each side of each void being formed from two facets that meet to define a minor apex intermediate the first and second ends thereof, the distance (RM) from the geometric center of the void to each major apex and the distance ($R_m$) from the geometric center of the void to each minor apex defining an apex ratio ($R_M/R_m$) in the range from about 1.0 to about 1.55, each void being oriented within a filament such that each major apex of the void extends toward the approximate midpoint of one side of the exterior of the filament and each minor apex extends toward an exterior tip of a filament, each void occupying from about four percent (4%) to about twenty-five percent (25%) of the cross sectional area of the filament.

12. The carpet of claim 11 wherein the exterior modification ratio ($R_2/R_1$) of each of said bulked continuous filaments is in the range from about 1.6 to about 1.8.

13. The carpet of claim 11 wherein the tip ratio ($R_2/R_3$) of each of said bulked continuous filaments is in the range from about 2.0 to about 3.0.

14. The carpet of claim 11 wherein the wherein the apex ratio ($R_M/R_m$) of each of said the bulked continuous filaments is in the range from about 1.05 to about 1.50.

15. The carpet of claim 11 wherein the void of each of said bulked continuous filaments occupies from about four percent (4%) to about fifteen percent (15%) of the cross sectional area of the filament.

* * * * *